US007198079B2

(12) United States Patent
Kline

(10) Patent No.: US 7,198,079 B2
(45) Date of Patent: Apr. 3, 2007

(54) LIQUID DELIVERY SYSTEM OF GAS MASK

(75) Inventor: Dale Kline, Walkersville, MD (US)

(73) Assignee: TVI Corporation, Glenn Dale, MD (US)

( * ) Notice: Subject to any disclaimer, the term of this patent is extended or adjusted under 35 U.S.C. 154(b) by 497 days.

(21) Appl. No.: 10/657,233

(22) Filed: Sep. 9, 2003

(65) Prior Publication Data

US 2005/0051235 A1 Mar. 10, 2005

(51) Int. Cl.
*B65B 1/04* (2006.01)

(52) U.S. Cl. ..... 141/353; 141/351; 141/383; 128/202.15; 251/149.6

(58) Field of Classification Search ..... 141/312, 141/351–357, 383, 386; 128/202.15; 251/149.6
See application file for complete search history.

(56) References Cited

U.S. PATENT DOCUMENTS

| | | | | |
|---|---|---|---|---|
| 865,996 | A | 9/1907 | Catt | |
| 1,105,127 | A | 7/1914 | Drager | |
| 1,169,996 | A | 2/1916 | Prindle | |
| 3,018,776 | A | 1/1962 | Saitta | |
| 3,044,464 | A | 7/1962 | Gray | |
| 3,715,032 | A | 2/1973 | Nicko | |
| 3,731,717 | A * | 5/1973 | Potash | 141/379 |
| 3,852,196 | A | 12/1974 | Szpur | |
| 3,990,439 | A | 11/1976 | Klinger | |
| 4,243,029 | A | 1/1981 | Apple | |
| 4,257,415 | A | 3/1981 | Rubin | |
| 4,384,576 | A | 5/1983 | Farmer | |
| 4,402,316 | A | 9/1983 | Gadberry | |
| 4,433,684 | A | 2/1984 | Sarnoff et al. | |
| 4,436,125 | A * | 3/1984 | Blenkush | 141/330 |
| 4,493,614 | A | 1/1985 | Chu | |
| 4,513,741 | A | 4/1985 | Demi | |
| 4,529,514 | A | 7/1985 | Gruett | |
| 4,574,799 | A | 3/1986 | Warncke | |
| 4,682,993 | A | 7/1987 | Todd | |
| 4,823,785 | A | 4/1989 | Mancosu et al. | |
| 4,841,963 | A | 6/1989 | Vandeputte | |

(Continued)

FOREIGN PATENT DOCUMENTS

DE 0292432 A1 * 11/1988

(Continued)

*Primary Examiner*—Timothy L. Maust
(74) *Attorney, Agent, or Firm*—R. Christopher Rueppell; Whiteford, Taylor & Preston, L.L.P.

(57) ABSTRACT

A gas mask liquid delivery system including a gas mask having a liquid inlet port. A liquid control adapter having a body with a first end with an outlet opening formed therein, a second end with an inlet opening formed therein, and an interior chamber formed within the body. An inlet chamber extends from the inlet opening to the interior chamber and an outlet chamber extends from the outlet opening to the interior chamber. The inlet and outlet openings, inlet, interior, and outlet chambers, define a flow path when placed in open communication with each other to permit liquid to flow through the flow path. A stopper controls the flow of the liquid through the flow path. The outlet opening connects the adapter to the liquid inlet port. A flow tube connects a liquid source to a connector, wherein the inlet opening of the adapter is connected to the connector.

32 Claims, 10 Drawing Sheets

U.S. PATENT DOCUMENTS

| | | | | |
|---|---|---|---|---|
| 4,915,106 | A | 4/1990 | Aulgur | |
| 4,924,861 | A | 5/1990 | Kiske | |
| 4,936,298 | A | 6/1990 | Nishina | |
| 4,961,420 | A | 10/1990 | Cappa et al. | |
| 4,971,051 | A | 11/1990 | Toffolon | |
| H863 | H | 1/1991 | Kwiedorowicz et al. | |
| 5,036,846 | A | 8/1991 | Aulgur | |
| 5,065,745 | A | 11/1991 | Meier | |
| 5,209,226 | A | 5/1993 | Goodley | |
| 5,235,972 | A | 8/1993 | Strong | |
| 5,427,091 | A | 6/1995 | Phillips | |
| 5,503,147 | A | 4/1996 | Bertheau | |
| 5,690,102 | A | 11/1997 | Bertheau | |
| 5,914,037 | A | 6/1999 | Yen | |
| 6,039,045 | A | 3/2000 | Bertheau | |
| 6,155,258 | A | 12/2000 | Voege | |
| 6,214,074 | B1 | 4/2001 | Silviera | |
| 6,269,811 | B1 | 8/2001 | Duff | |
| 6,325,116 | B1 | 12/2001 | Savage et al. | |
| 6,615,828 | B1 | 6/2004 | Petherbridge | |
| 6,796,304 | B2 | 9/2004 | Odell | |
| 6,823,867 | B2 | 11/2004 | Avery | |
| 6,834,650 | B1 | 12/2004 | Fini | |
| 6,837,239 | B2 | 1/2005 | Beizndtsson | |
| 6,932,239 | B2 * | 8/2005 | McKitrick | 222/83 |
| 7,101,412 | B2 | 9/2005 | Gossweiler | |
| 2003/0005932 | A1 | 1/2003 | Rydgren | |
| 2005/0103343 | A1 | 5/2005 | Gossweiler | |
| 2005/0126572 | A1 | 6/2005 | Gossweiler | |
| 2005/0263155 | A1 | 12/2005 | Gossweiler | |
| 2006/0048782 | A1 | 3/2006 | Gossweiler | |

FOREIGN PATENT DOCUMENTS

| | | | |
|---|---|---|---|
| DE | 4241033 | A1 | 6/1994 |
| WO | 2005035365 | A2 | 4/2005 |
| WO | 2005055912 | A2 | 6/2005 |
| WO | 2005060374 | A2 | 7/2005 |
| WO | 2005061076 | A1 | 7/2005 |
| WO | 2005118072 | A1 | 12/2005 |
| WO | 2006028467 | A2 | 3/2006 |

* cited by examiner

LIQUID DELIVERY SYSTEM OF GAS MASK

BACKGROUND OF THE INVENTION

1. Field of the Invention

The present invention relates to a liquid delivery system of a gas mask which permits continuous connection to a liquid source without requiring a gas mask wearer to remove the gas mask or connect and disconnect the liquid source to the gas mask each time the wearer wishes to drink from the liquid source.

2. Description of Related Art

Conventionally, a gas mask wearer, such as, for example only, a firefighter, rescue personnel, member of the military, and the like, desiring a drink while working in an environment containing harmful and possibly fatal air-born toxins must leave the environment so as not to contaminate the liquid source from which they intend to drink. Accordingly, the wearer of the gas mask is required to interrupt or stop performing their duties to leave the work environment.

Alternatively, the wearer of the gas mask must connect the liquid source, such as, for example only, a canteen, to the gas mask while the wearer is in the harmful environment, which may require the wearer to put down any items in their hands, pick up the liquid source, and connect the liquid source to the gas mask so they may access the fluids in the liquid source. Such steps not only interrupt the work being performed by the gas mask wearer, but introduce an undesirable risk of contaminating the liquid source or the wearer while being connected to and/or disconnected from the gas mask. Further, attaching the liquid source to the gas mask typically creates a visual obstruction, thereby limiting the field of vision of the gas mask wearer. Any obstruction limiting the field of vision is undesirable as the wearer of the gas mask is prevented from clearly seeing their surroundings.

Another alternative may require the gas mask wearer to remove the gas mask to take a drink while they are in the harmful environment. Such an activity may prove harmful or fatal, depending on the toxins present in the harmful environment.

Each of the above-mentioned alternatives require a wearer of the gas mask to temporarily or permanently suspend their activities and possibly remove the gas mask in order to drink from the liquid source. Accordingly, there is a need for a system, and/or method, and/or device which delivers liquid to a gas mask wearer with a low risk of contamination of the drinking liquid, without interrupting the duties of the wearer, exposing the wearer to risk or physical danger, and/or obstructing the field of vision of the wearer.

SUMMARY OF THE INVENTION

The present invention overcomes the above-described drawbacks associated with conventional gas mask liquid delivery systems, as well as others, by allowing a gas mask wearer to remain continuously connected to a liquid source while wearing the gas mask. The present invention substantially reduces the risk of contaminating the liquid source, eliminates the need for the wearer to interrupt their duties or otherwise leave the working environment to drink from the liquid source, does not obstruct the field of vision of the wearer permits the wearer to drink from the liquid source without having to use their hands, and provides other self-evident advantages.

In accordance with one embodiment of the present invention, a liquid delivery system includes a gas mask assembly, an adapter, a liquid flow tube, a connector, and a liquid source. The gas mask assembly includes a liquid inlet port, wherein a first end of the liquid inlet port is connected to a drinking tube provided on an interior of the gas mask and a second end of the liquid inlet port is connected to a first end of the adapter. Once the adapter and liquid inlet port are connected, an internal valve of the adapter and an internal valve of the liquid inlet port are opened, wherein the drinking tube, liquid inlet port, and adapter are in communication with each other. A first end of the connector is connected to a second end of the adapter.

In one embodiment, an internal valve within the connector is opened when the adapter and connector are connected together, thereby permitting communication between the adapter and the connector. A fluid flow tube joins a second end of the connector to the liquid source.

By connecting the above-mentioned components together, the liquid within the liquid source is able to flow freely from the liquid source to the drinking tube within the gas mask. Accordingly, once connected to the liquid delivery system, a wearer of the gas mask is able to drink liquids from the liquid source at any moment while wearing the gas mask. Furthermore, the wearer of the gas mask is able to drink liquids from the liquid source without compromising their field of vision and may drink from the liquid source hands-free.

Additional advantages and novel features of the present invention will become more apparent from the following description.

DETAILED DESCRIPTION OF THE PRESENT INVENTION

The present invention provides a liquid delivery system which is illustrated in FIGS. 1 through 16.

Figure 1:
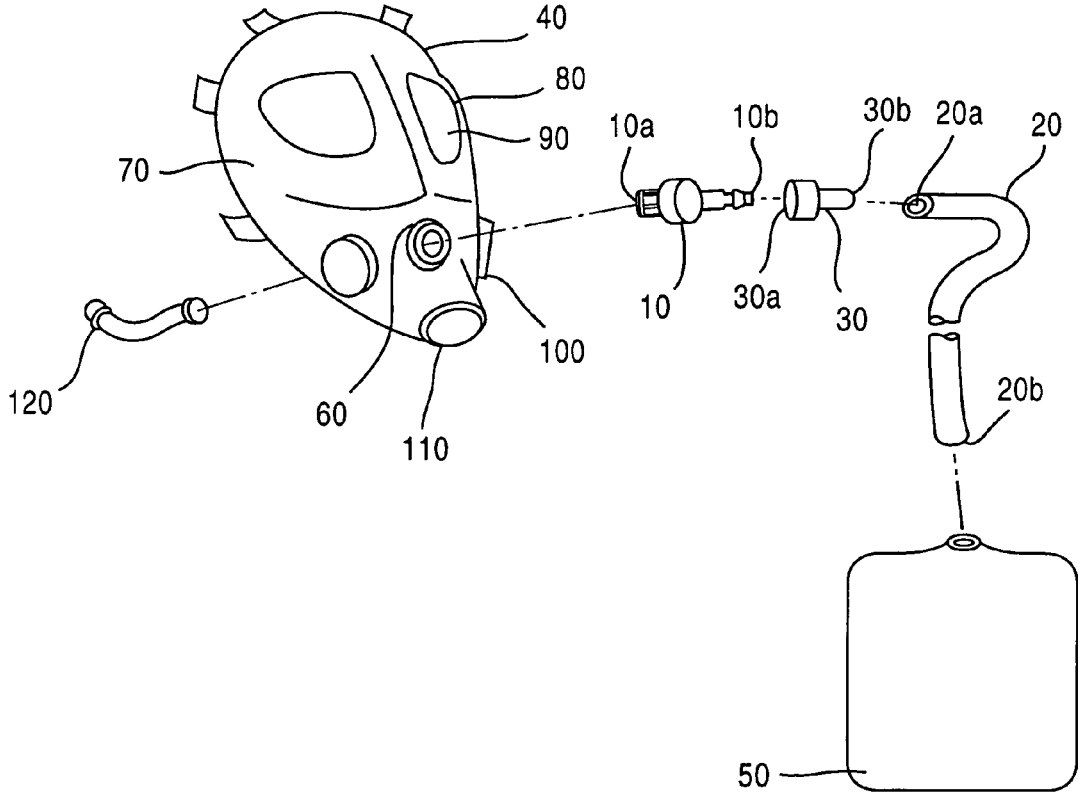
FIG. 1 is an exploded perspective view of a liquid delivery system, in accordance with an embodiment of the present invention.

In particular, FIG. 1 illustrates an embodiment of the liquid delivery system according to the present invention including an adapter 10, a liquid flow tube 20, a connector 30, a gas mask 40, and a liquid source 50. A first end 10*a* of the adapter 10 is connected to a liquid inlet port 60 of the gas mask 40. The gas mask 40 includes a facemask 70, at least one aperture 80 in the facemask 70, an eye lens 90 inserted into each aperture 80 to permit the wearer to see out of the gas mask 40, at least one air inlet port 100 to permit the intake of air into the interior of the gas mask 40, an air exhaust port 110 to permit exhaust gas to be expelled from the interior of the gas mask 40, and a drinking tube 120 located on the interior of the gas mask 40 which permits the wearer to access liquid from the liquid source 50. One embodiment of the gas mask 40 is an NBC M'95 gas mask, manufactured by Scott Health & Safety OY of Vaasa, Finland.

A second end 10*b* of the adapter 10 is connected to a first end 30*a* of the connector 30. A first end 20*a* of the liquid flow tube 20 is connected to a second end 30*b* of the connector 30. A second end 20*b* of the liquid flow tube 20 is connected to the liquid source 50.

Figure 2:
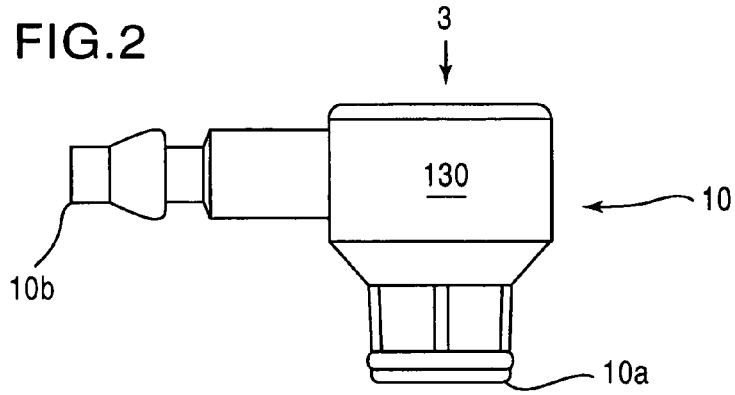
FIG. 2 is a side view of an adapter usable with the liquid delivery system shown of FIG. 1.
Figure 3:
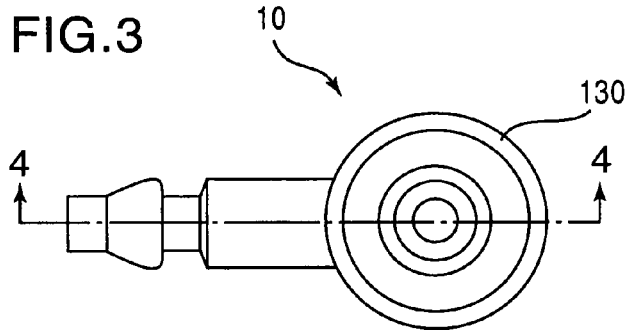
FIG. 3 is a plan view of the adapter of FIG. 2.
Figure 4:
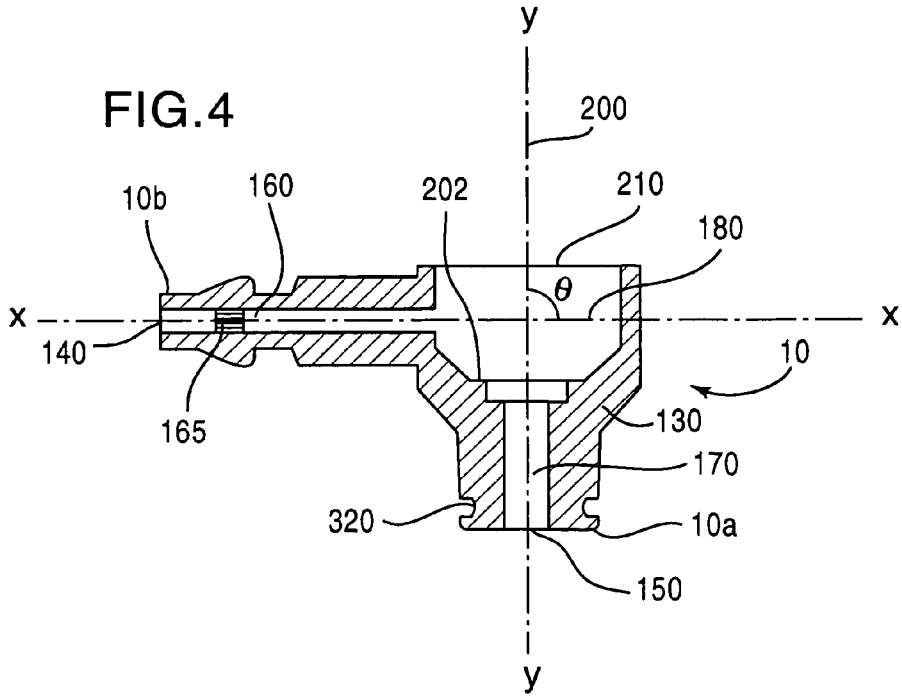
FIG. 4 is a cross-sectional view of the adapter taken along line 4—4 of FIG. 3.

FIGS. 2–4 illustrate details of the adapter 10. In particular, FIG. 2 illustrates a side view of the adapter 10, FIG. 3 illustrates a plan view of the adapter 10, and FIG. 4 illustrates a cross-sectional view of the adapter 10 taken along line 4—4 of FIG. 3. The adapter 10 includes a body 130 having an inlet 140 at the second end 10*b* of the adapter 10 and an outlet 150 at the first end 10*a* of the adapter 10. Preferably, the body 130 of the adapter 10 is formed from a non-malleable material, such as, for example only, a hard plastic. However, it is within the scope of the present invention to form the body 130 of the adapter 10 from any other suitable material which should be dictated by the environment in which the adapter 10 is to be used.

An inlet chamber 160 extends from the inlet 140 to an interior chamber 180 along a first axis x—x, and an outlet chamber 170 extends from the outlet 150 to the interior chamber 180 along a second axis y—y. A plunger 165 is disposed within the inlet chamber 160 a predetermined distance from the inlet 140. As shown in the exemplary embodiment illustrated in FIG. 4, the first axis x—x and second axis y—y are substantially orthogonal relative to each other and form a substantial right angle therebetween. However, it should be noted that it is within the scope of the present invention to very the angular relationship between the first axis x—x and second axis y—y to be more acute or more oblique relative to each other, wherein an angle θ between the axes x—x and y—y is in a range of approximately 5° to 175°.

In one embodiment, the inlet chamber 160 is coaxial with the first axis x—x while the outlet chamber 170 is coaxial with the second axis y—y. The second axis y—y is preferably coaxial with a centerline 200 of the interior chamber 180. The interior chamber 180 defines an opening 210 of the adapter 10 which communicates with the exterior of the adapter 10. Preferably, the opening 210 is circular in shape, however, it is within the scope of the present invention to provide the opening 210 with any suitable geometric configuration, such as, for example only, triangular, square, rectangular, pentagonal, hexagonal, and the like. Furthermore, although not required, it is within the scope of the present invention to have the opening 210 be coaxial with centerline 200 of the interior chamber 180.

Figure 5:
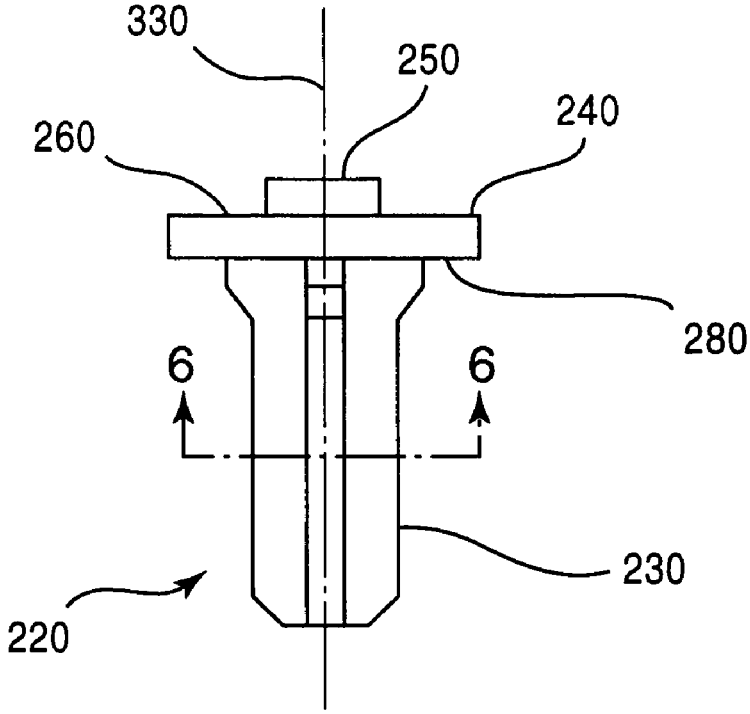
FIG. 5 is a side view of a stopper housed within the adapter body.

FIG. 5 is a side view of a stopper 220 housed within the body 130 of the adapter 10. The stopper 220 has a rod-shaped lower portion 230 and an upper flange 240. Preferably, the flange 240 has an outer diameter that is larger than an outer diameter of the rod-shaped lower portion 230 relative to a longitudinal axis 330 of the stopper 220. However, it is within the scope of the present invention to have the outer diameter of the flange 240 be equal to the outer diameter of the rod-shaped lower portion 230. Moreover, it should be noted that the longitudinal axis 330 of the stopper 220 is coaxial with the axis y—y of the adapter 10.

A retainer 250 extends from an upper surface 260 of the flange 240. A first gasket 270 (FIG. 7) is disposed about the rod-shaped lower portion 230 and abuts a lower surface 280 of the flange 240. Preferably, the gasket 270 is an O-ring formed from a suitable material, such as, for example only, a polymer. The stopper 220 is configured to be disposed within the interior chamber 180 and outlet chamber 170 of the adapter 10 (FIG. 7) wherein the flange 240 and retainer 250 are located in the interior chamber 180 and the rod-shaped lower portion 230 extends from the interior chamber 180 into the outlet chamber 170.

Figure 6:
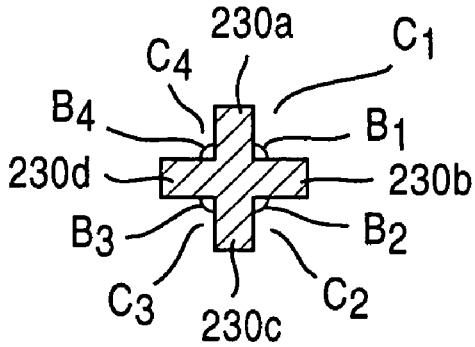
FIG. 6 is a cross-sectional view taken along line 6—6 of the stopper of FIG. 5.

FIG. 6 is a cross-sectional view of the rod-shaped lower portion 230 of the stopper 220 taken along line 6—6 of FIG. 5. The rod-shaped lower portion 230 is formed by a plurality of arms $\mathbf{230}_{a\text{-}d}$ having an outer diameter substantially equal to the inner diameter of the outlet chamber 170. However, it is within the scope of the present invention that the outer diameter of the arms $\mathbf{230}_{a\text{-}d}$ be less than an inner diameter of the outlet chamber 170 such that there is a gap between a longitudinal end face of each arm and the inner diameter of the outlet chamber 170.

Figure 6A:
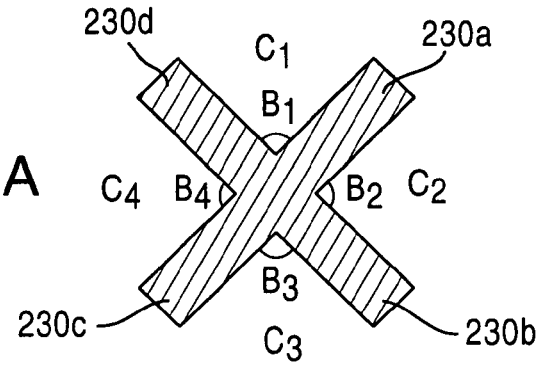
FIGS. 6A–C illustrate alternate embodiments of the cross-sectional view of FIG. 6.
Figure 6B:
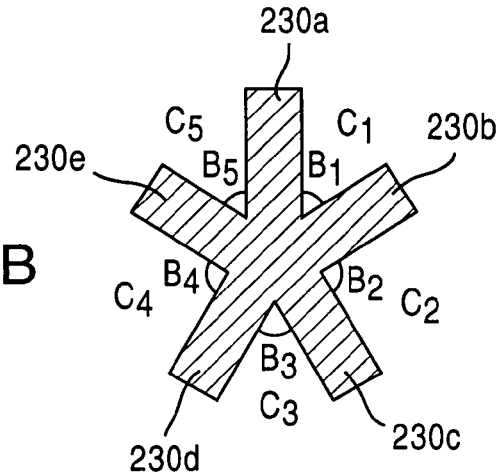
Figure 6C:
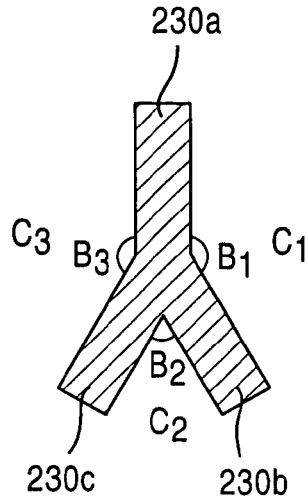

Preferably, the arms $\mathbf{230}_{a\text{-}d}$ form an X shape in cross-section having equal angles $\beta_{1\text{-}4}$, i.e., $\beta_1=\beta_2=\beta_3=\beta_4$, between corresponding arms $\mathbf{230}_{a\text{-}d}$. However, it is within the scope of the present invention to have the angles $\beta_{1\text{-}4}$ between the arms $\mathbf{23}_{a\text{-}d}$ not equal to each other, e.g., $\beta_1=\beta_3<\beta_2=\beta_4$, as shown in the exemplary embodiment of FIG. 6A, as well as to increase the number of arms $\mathbf{230}_{a\text{-}e}$ and angles $\beta_{1\text{-}5}$ therebetween, as shown in the exemplary alternate embodiment of FIG. 6B, as well as to decrease the number of arms $\mathbf{230}_{a\text{-}c}$ and corresponding angles $\beta_{1\text{-}3}$ therebetween, as shown in another exemplary alternate embodiment of FIG. 6C. The exemplary embodiment shown in FIG. 6B has a five armed star shape while the embodiment shown in FIG. 6C has a three armed star shape.

The X or star shape of the rod-shaped lower portion 230 defines a plurality of longitudinal channels $C_{1\text{-}4}$ (FIGS. 6 and 6A), $C_{1\text{-}5}$ (FIG. 6B), or $C_{1\text{-}3}$ (FIG. 6C) extending through the outlet chamber 170 bounded by corresponding arms $\mathbf{230}_{a\text{-}d}$ (FIGS. 6 and 6A), $\mathbf{230}_{a\text{-}e}$ (FIG. 6B), and $\mathbf{230}_{a\text{-}c}$ (FIG. 6C), respectively, and the interior surface of the outlet chamber 170. Furthermore, it is within the scope of the invention to increase the number of arms $\mathbf{230}_{a\text{-}e}$ to be more than five, such as, for example only, from 6–100 arms, in order to provide a stopper 220 having a significant plurality of channels defined therebetween.

Once the stopper 220 and gasket 270 are positioned within the interior chamber 180, the gasket 270 rests against a lip 202 defined by a lower end of the interior chamber 180. In one embodiment, the adapter 10 is biased in a sealed position, preventing any fluid flow out of the outlet 150. In one embodiment, the stopper 220 is formed from a suitable material, such as, for example only, plastic or metal.

Figure 7:
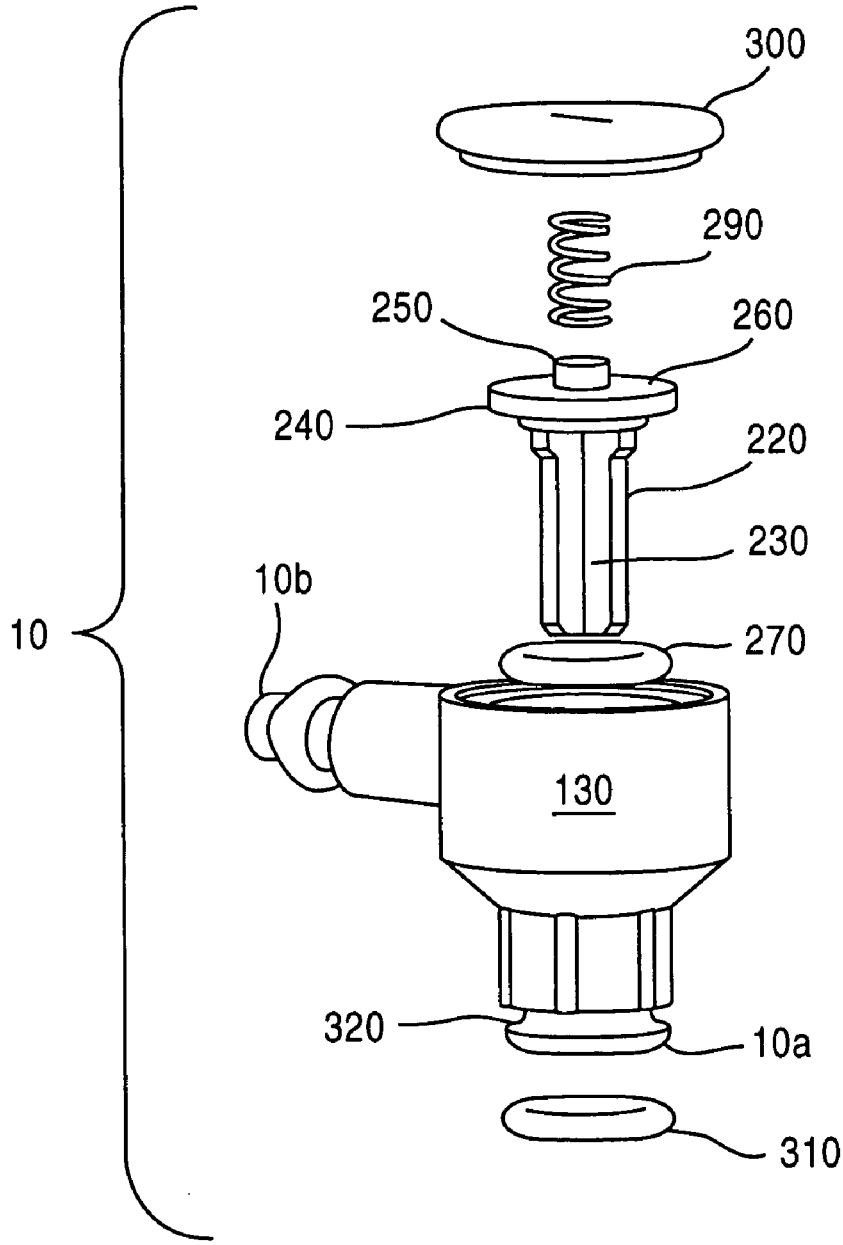
FIG. 7 is an exploded perspective view of the adapter of FIG. 2.

FIG. 7 is an exploded perspective view of one embodiment of the adapter 10, wherein one end of a spring 290 is disposed about the retainer 250 and abuts the upper surface 260 of the flange 240. A lid 300, which closes the opening 210 of the interior chamber 180, compresses the spring 290 and creates an airtight seal at an interface between the opening 210 and the lid 300. Upon assembly, the spring 290 biases the stopper 220 via the upper surface 260 downward and away from the lid 300 to compress the gasket 270 between the lower surface 280 of the flange 240 and the lip 202 of the outlet chamber 170 within the interior chamber 180.

In one embodiment, the compressed gasket 270 creates an airtight seal. The spring 290 also biases the adapter 10 in a closed position. A second gasket 310 is disposed within a groove 320 disposed about an exterior surface 320 of the outlet 150 (FIGS. 4 and 7). Preferably, the second gasket 310 is an O-ring formed from a suitable material, such as, for example only, a polymer.

The stopper 220 is displaced within the outlet chamber 170 when a displacing force, sufficient in magnitude to overcome the compressive load of the spring 290, is exerted on the rod-shaped lower portion 230 of the stopper 220 in a direction parallel to the longitudinal axis 330 of the stopper 220. The longitudinal displacement of the stopper 220 further compresses the spring 290 and unseats the gasket 270, allowing the outlet chamber 170 to be in open communication with the interior chamber 180. Because the inlet chamber 160 communicates with the interior chamber 180, the longitudinal movement of the stopper 220 allows the inlet chamber 160, the interior chamber 180, and the outlet chamber 170 to be in open communication with each other. Accordingly, the communication between the inlet chamber 160, interior chamber 170, and outlet chamber 180 permits liquid to flow through the adapter 10 by way of the inlet 140, the inlet chamber 160, the interior chamber 180, the channels $C_{1\text{-}5}$ defined by the longitudinal outer end faces of the arms $\mathbf{230}_{a\text{-}e}$ of the rod-shaped lower portion 230 and the interior surface of the outlet chamber 170, and the outlet 150.

Figure 8:
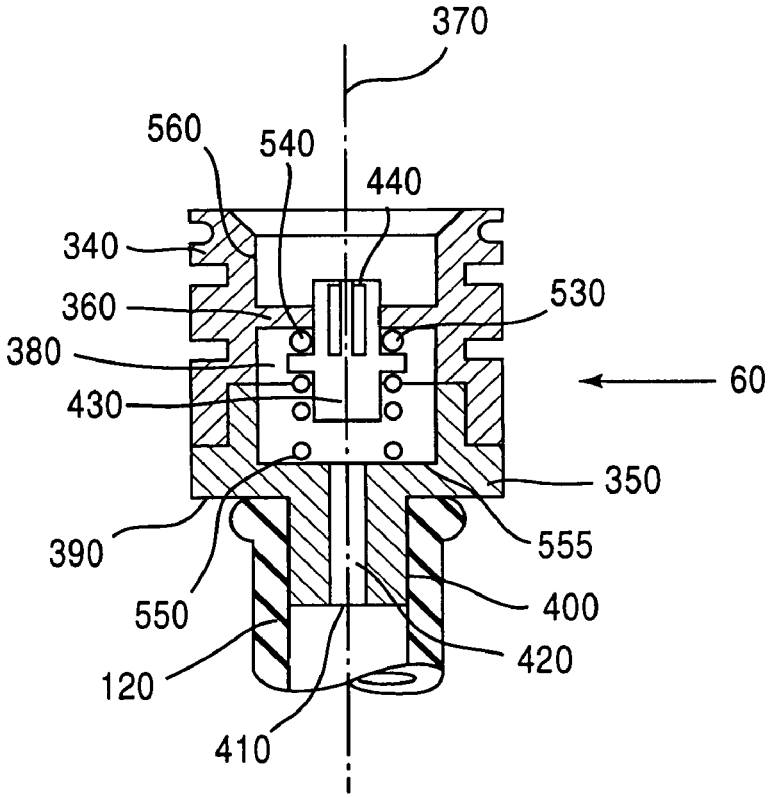
FIG. 8 is a cross-sectional view of a liquid inlet port of a gas mask used with the liquid delivery system of FIG. 1.

FIG. 8 is a cross-sectional view of the liquid inlet port 60 of the gas mask 40 (FIG. 1). The liquid inlet port 60 includes an upper portion 340 fittably connected to a lower portion 350. Upon connection to the gas mask 40, the upper portion 340, which includes a flange 360 extending radially inward therefrom, extends toward the exterior of the gas mask 40. In one embodiment, the flange 360 is perpendicular to a longitudinal axis 370 of the liquid inlet port 60. It should be noted that it is within the scope of the invention to have the flange 360 extend obliquely relative to the longitudinal axis 370 of the liquid inlet port 60. Upon connection to the gas mask 40, the lower portion 350 extends towards the interior of the gas mask 40. Upon connection, the upper portion 340 and lower portion 350 define an interior chamber 380.

In one embodiment, the lower portion 350 includes an exterior surface 390 and an extension 400. The extension 400 of the lower portion 350 extends outwardly from the exterior surface 390. An outlet chamber 420 is defined in and extends along an entire length of the lower portion 350 and terminates at an outlet 410.

Figure 9:
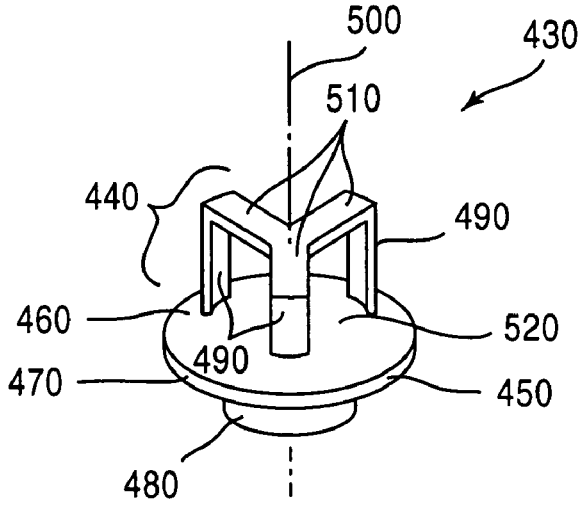
FIG. 9 is a perspective view of a moveable valve in the liquid inlet port of FIG. 8.

A moveable valve 430 is provided within the liquid inlet port 60. As shown in FIG. 9, one embodiment of the moveable valve 430 includes a case extension 440, a flange 450, a flange upper surface 460, a flange lower surface 470, and a retainer 480. The case extension 440 extends upwards from the flange upper surface 460.

In one embodiment, the case extension 440 includes three tabs 490 extending away from the flange upper surface 460 in a direction parallel to a longitudinal axis 500 of the moveable valve 430. Preferably, the top of the case extension 440 includes three spokes 510 radially extending from a central union point. In one embodiment, the spokes 510 are approximately perpendicular to the tabs 490. Each tab 490 joins an individual spoke 510, forming an open chamber 520. However, it is within the scope of the instant invention that the case extension 440 of the moveable valve 430 includes other suitable configurations, such as having an X shaped cross-section.

As shown in FIG. 8, a third gasket 530 is disposed about the case extension 440, and, when the moveable valve 430 is inserted into the liquid inlet port 60, the gasket 530 is sandwiched between the flange upper surface 460 and the flange 360. Preferably, the gasket 530 is an O-ring formed from a suitable material, such as, for example only, a polymer.

The case extension 440 extends through an opening 540 formed in the flange 360. Once assembled, the gasket 530 abuts a lower surface of flange 360. A first end of a spring 550 is disposed about the retainer 480 (FIG. 9) of the moveable valve 430 to abut the lower flange surface 470 (FIG. 9). A second end of the spring 550 abuts an interior surface 555 of the lower portion 350, which engages the upper portion 340 to create an airtight seal.

When the spring 550 is compressed to bias the liquid inlet port 60 in a normally closed position, liquid is prevented from flowing through the liquid inlet port 60. The compressed spring 550 forces the flange 450 toward the flange 360, wherein the gasket 530 is compressed and an airtight seal is formed therebetween.

Upon insertion of the assembled adapter 10 into the liquid inlet port 60, the gasket 310 is compressed between an inner surface 560 of the upper portion 340 of the liquid inlet port 60 and the exterior surface 320 of the outlet chamber 170 of the adapter 10 to form an airtight seal. During insertion of the assembled adapter 10 into the liquid inlet port 60, the case extension 440 of the moveable valve 430 engages the bottom of the rod-shaped lower portion 230 of the stopper 220. As a result, the springs 290 and 550 operate cooperatively to further compress each other. As the springs 550 and 290 compress, the stopper 220 and moveable valve 430 are displaced to unseat the gaskets 270 and 530, respectively.

Figure 10:
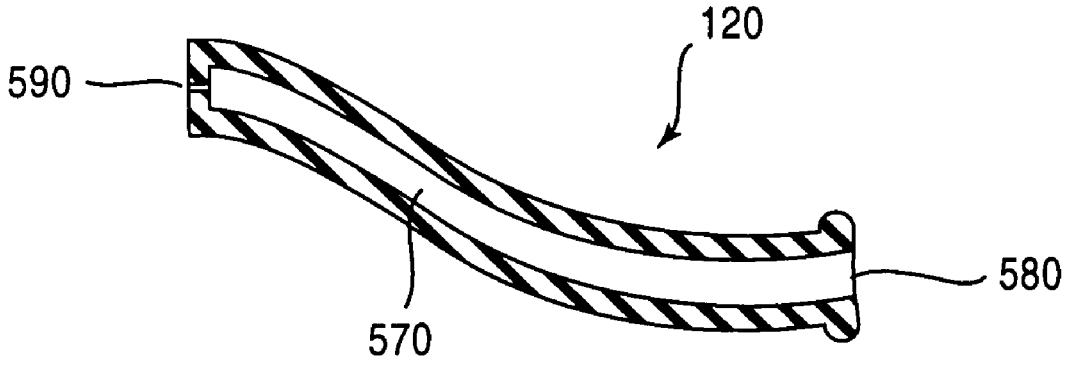
FIG. 10 is a cross-sectional view of a drinking tube.

FIG. 10 shows a cross-sectional view of one embodiment of the drinking tube 120 having an interior passage 570 extending from an inlet 580 to an outlet 590. Upon assembly, the inlet 580 of the drinking tube 120 attaches to the outlet 410 of the lower portion 350 of the liquid inlet port 60 (FIG. 8). The interior passage 570 of the drinking tube 120 has an inner diameter configured to provide a snug fit with an exterior surface of the extension 400 and abut the exterior surface 390 of the lower portion 350, as shown in FIG. 8, to form an airtight seal therebetween.

In one embodiment, upon assembly wherein the adapter 10 and the drinking tube 120 are each connected to the liquid inlet port 60, liquid can flow between the outlet 150 of the adapter 10 and the outlet 590 of the drinking tube 120. The liquid flows from the opening 540 of the liquid inlet port 60, through the open chamber 520 of the movable valve 430, through the interior and outlet chambers 380 and 420, respectively of the liquid inlet port 60, and out the outlet 410 of the liquid inlet port 60.

The liquid then flows from the outlet 410 of the liquid inlet port 60 through the drinking tube 120, via the inlet 580, interior passage 570, and outlet 590. In one embodiment, the drinking tube 120 is formed from a flexible material, such as rubber, metal, or fabric. In another embodiment, the outlet 590 is biased in a normally closed position, requiring the wearer of the gas mask 40 to bite down on the outlet 590 to open the drinking tube 120.

Figure 11:
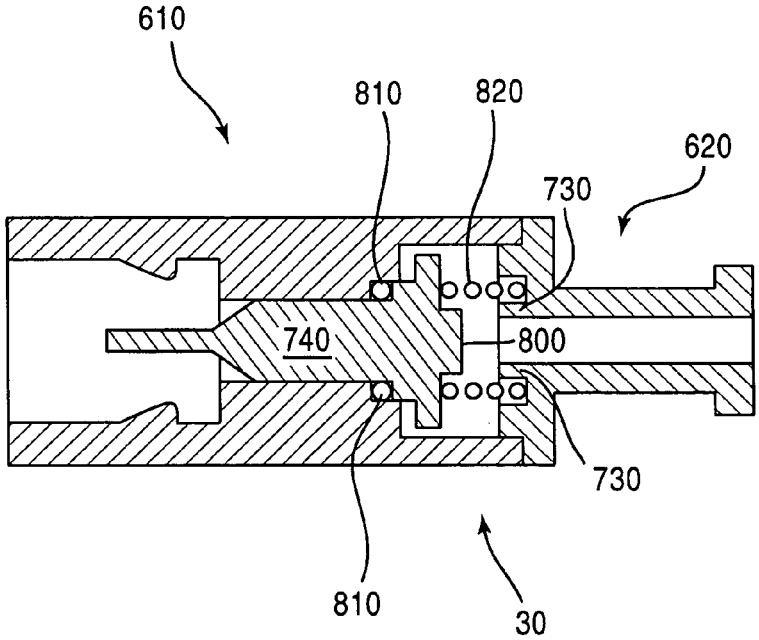
FIG. 11 is a cross-sectional view of a connector usable with the liquid delivery system shown of FIG. 1.
Figure 12:
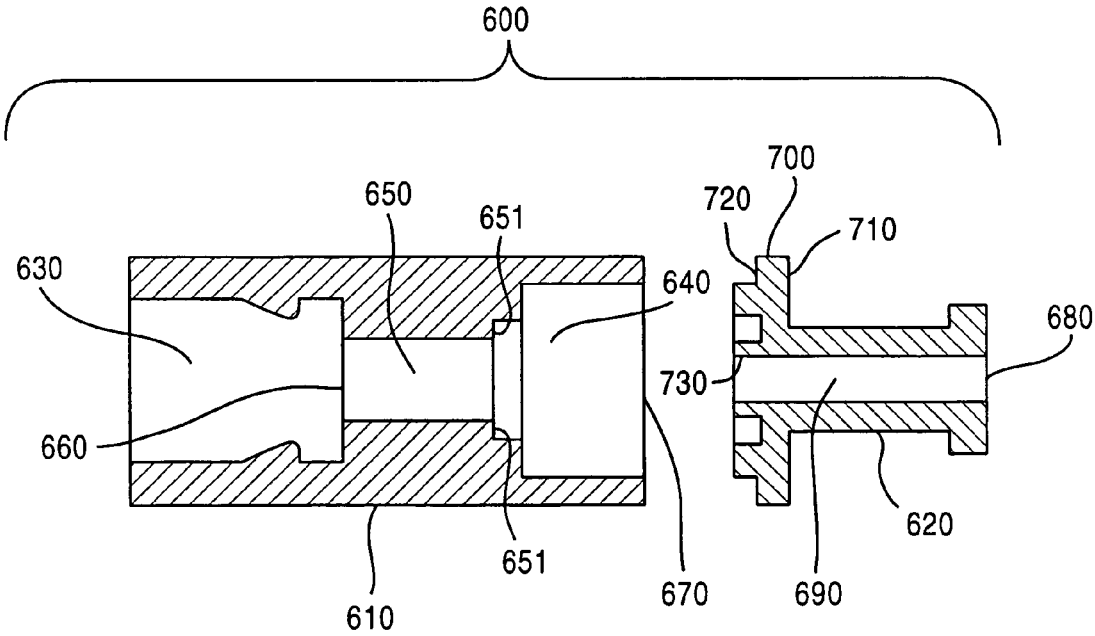
FIG. 12 is an exploded cross-sectional view of the connector of FIG. 11.

FIG. 11 shows a cross-sectional view of one embodiment of the connector 30, and FIG. 12 shows an exploded cross-sectional view of a housing 600 of the connector 30 of FIG. 11. The housing 600 includes a first portion 610 fittably connected to a second portion 620. The first portion 610 includes an adapter port 630 at a first end, an interior chamber 640 at a second end, and an outlet chamber 650 joining the adapter port 630 and the interior chamber 640. The first portion 610 also includes an outlet 660 positioned between the outlet chamber 650 and the adapter port 630. The interior chamber 640 has an opening 670 located at an outside end of the first portion 610 which permits the interior chamber 640 to communicate with the exterior of the first portion 610.

The second portion 620 includes an inlet 680 at a first end with an inlet chamber 690 extending therefrom through the second portion 620. The second portion 620 includes a flange 700 at a second end, wherein the flange 700 includes an outer surface 710 and an inner surface 720. The flange 700 extends in a direction substantially orthogonal to a longitudinal axis of the second portion 620. A retainer 730 extends from the inner surface 720 of the flange 700 in a direction substantially parallel to the longitudinal axis of the second portion 620. Upon assembly, the inlet chamber 690 of the second portion 620 communicates with the interior chamber 640 at the opening 670 of the first portion 610.

Figure 13:
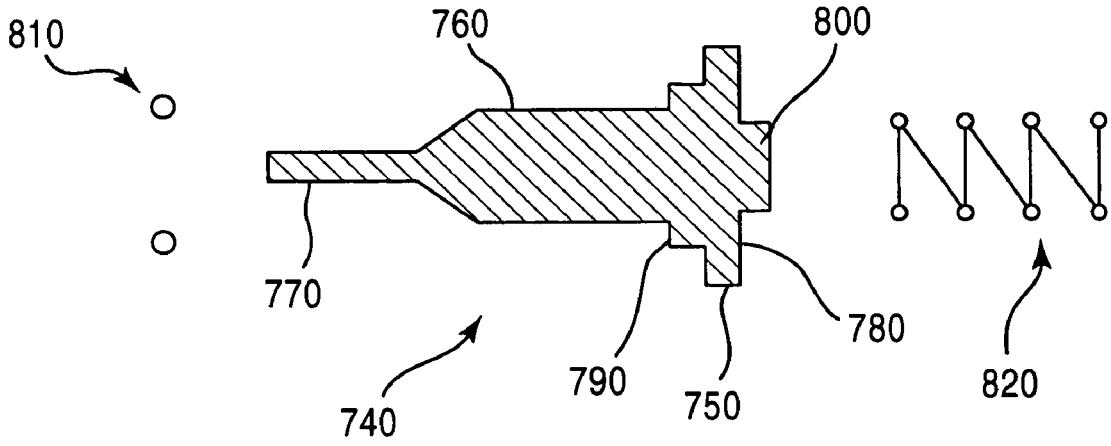
FIG. 13 is a cross-sectional view of internal components of the connector of FIG. 11.

FIG. 13 illustrates a moveable connector valve 740 for the connector 30. The moveable connector valve 740 includes a flange 750, a rod-shaped intermediate portion 760, and a projection 770 extending from an end of the intermediate portion 760 remote from the flange 750, which includes a first surface 780 and a second surface 790. A retainer 800 extends from the first surface 780 in a direction away from the projection 770. A connector gasket 810 is disposed about the rod-shaped intermediate portion 760 and abuts the second surface 790 of the flange 750. Preferably, the connector gasket 810 is an O-ring formed from a suitable material, such as, for example only, a polymer.

The rod-shaped intermediate portion 760 extends through the opening 670 into the outlet chamber 650. When the moveable valve 740 is inserted into the first portion 610 of the connector 30, the gasket 810 is sandwiched between the second surface 790 of the flange 750 and a lip 651 of the outlet chamber 650.

Figure 14:
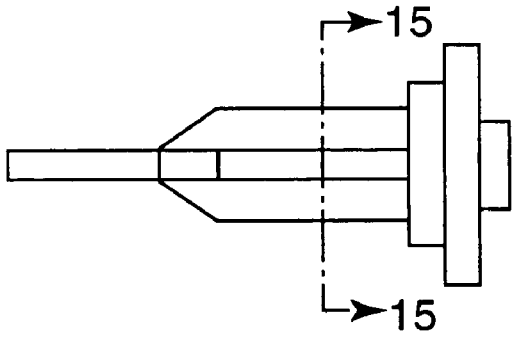
FIG. 14 is a side view of an internal valve of the connector of FIG. 11.
Figure 15:
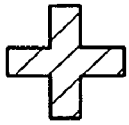
FIG. 15 is a cross-sectional view taken along line 15—15 of the valve of FIG. 14.

FIGS. 14 and 15 show one embodiment of the rod-shaped intermediate portion 760 having an X shaped cross section. Preferably, the outer diameter of the rod-shaped intermediate portion 760 is substantially equal to the internal diameter of the outlet chamber 650. However, it is within the scope of the present invention that the rod-shaped intermediate portion 760 has an outer diameter that is less than the internal diameter of the outlet chamber 650. The X shape of the intermediate portion 760 defines longitudinal channels extending through the outlet chamber 650 which are bounded by the arms of the intermediate portion 760 and the interior walls of the outlet chamber 650.

As shown in FIG. 11, a first end of the spring 820 is disposed about the retainer 800 and abuts the first surface 780 of the flange 750. A second end of the spring 820 is disposed about the retainer 730 and abuts the inner surface 720 of the second portion 620 of the connector. The spring 820 biases the connector 30 into a normally closed position. Further, the spring 820 compresses the gasket 810 between the second surface 790 and the lip 651 of the outlet chamber 650 to form an airtight seal.

In one embodiment, the inlet 140 of the adapter 10 is configured to be inserted into the adapter port 630 of the connector 30, thereby forming an airtight seal. Upon assembly, the projection 770 engages the plunger 165, thereby displacing the moveable connector valve 740 along the longitudinal axis of moveable connector valve 740. The displacement of the moveable connector valve 740 causes the spring 820 to further compress. As a result, the gasket 810 is unseated, thereby permitting communication between the inlet 140 of the adapter 10 and the outlet 660 of the connector 30 to permit liquid to flow between the adapter 10 and the connector 30.

Figure 16:
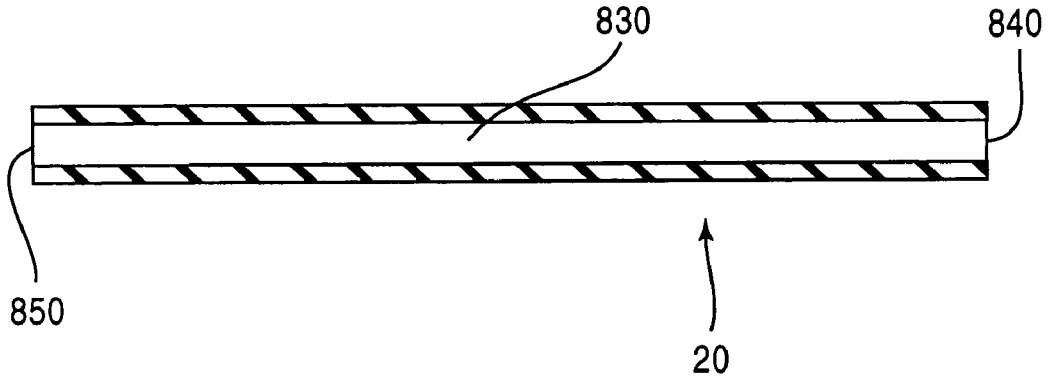
FIG. 16 is a cross-sectional view of a fluid flow tube usable with the liquid delivery system shown of FIG. 1.

FIG. 16 illustrates a cross-sectional view of the liquid flow tube 20 having an interior passage 830 connecting an inlet 840, and an outlet 850. The inlet 680 of the connector 30 affixes to the outlet 850 of the liquid flow tube 20. In one embodiment, an interior surface of the interior passage 830 is snugly fit onto an exterior wall of the inlet chamber 690 to form an airtight seal therebetween. The inlet 840 connects to the liquid source 50, thereby forming an airtight seal therebetween. Preferably, the liquid source 50 is a container that can be worn on the body of a wearer and in one embodiment, the liquid source 50 can be worn on the back of a wearer. In one embodiment, the liquid source 50 is formed from a flexible material. The liquid source 50 can include, for example, a Camelbak® hydration system, manufactured by Camelbak Maximum Gear of Petaluma, Calif. or a HydraStorm™ hydration system, manufactured by Blackhawk Industries, Inc. of Norfolk, Va. Moreover, it is within the scope of the present invention that the liquid source 50 can be formed from any suitable material, such as rubber or plastic, and be of any suitable configuration.

When the gas mask 40, adapter 10, connector 30, liquid flow tube 20, and liquid source 50 are appropriately connected, liquid is able to flow from the liquid source 50 to the drinking tube 120. The gas mask wearer can obtain a drink by positioning the drinking tube 120 in their mouth simply by using their tongue. Thereby, the present invention, as disclosed herein, allows a gas mask wearer to drink from a liquid source without requiring the wearer to temporarily or permanently suspend any work or other activity, because the liquid delivery system is continuously connected to the gas mask and operates hands-free.

While there has been described what are at present considered to be preferred embodiments of the present invention, it will be understood that various modifications may be made thereto, and it is intended that the appended claims cover all such modifications as fall within the true spirit and scope of the invention.

What is claimed is:

1. A liquid delivery adapter for use in delivering a liquid from a liquid source to a gas mask, the adapter comprising:

A body having a first end and a second end;

An inlet opening formed at the second end and an outlet opening formed at the first end;

An interior chamber formed within the body;

An inlet chamber extending along a first axis from the inlet opening to the interior chamber;

An outlet chamber extending along a second axis, that is coaxial with a longitudinal axis of the interior chamber, from the outlet opening to the interior chamber, wherein the inlet opening, inlet chamber, interior chamber, outlet chamber, and outlet opening define a flow path when placed in open communication with each other to permit the liquid to flow through the flow path; and A stopper disposed within the interior chamber and extending into the outlet chamber, wherein the stopper controls the flow of the liquid through the flow path.

2. The adapter according to claim 1, wherein an angle θ defined by the first axis and the second axis is in a range of 5° to 175°.

3. The adapter according to claim 1, further comprising a plunger disposed within the inlet chamber a predetermined distance from the inlet opening.

4. The adapter according to claim 1, wherein the interior chamber defines an opening which communicates with an exterior of the adapter, and wherein the interior chamber opening is opposite the outlet opening along at least one of the second axis and the longitudinal axis of the interior chamber.

5. The adapter according to claim 4, wherein the interior chamber opening is circular in shape.

6. The adapter according to claim 4, further comprising a lip defined by a lower portion of the interior chamber, the lip being disposed intermediate the interior chamber opening and the outlet opening along the longitudinal axis of the interior chamber.

7. The adapter according to claim 1, wherein the stopper can be biased between a first position, wherein the liquid is prevented from flowing through the flow path, and a second position, wherein the liquid is permitted to flow through the flow path.

8. The adapter according to claim 7, further comprising biasing means for biasing the stopper between the first position and the second position.

9. The adapter according to claim 8, wherein the biasing means is a spring.

10. The adapter according to claim 1, wherein the stopper comprises a flange and a rod-shaped lower portion extending from a lower surface of the flange, the flange of the stopper resting within the interior chamber and the rod-shaped lower portion of the stopper extending into the outlet chamber.

11. The adapter according to claim 10, wherein the flange has an outer diameter larger than an outer diameter of the rod-shaped lower portion.

12. The adapter according to claim 10, further comprising a retainer extending from an upper surface of the flange and biasing means for biasing the stopper between a first position which prevents the liquid from flowing through the flow path, and a second position which permits the liquid to flow through the flow path, and wherein the biasing means is disposed about the retainer and abuts the upper surface of the flange.

13. The adapter according to claim 10, wherein the rod-shaped lower portion of the stopper includes a plurality of arms defining a plurality of longitudinal channels through which the liquid can flow, wherein each longitudinal channel is defined by a pair of neighboring arms.

14. The adapter according to claim 10, further comprising a first gasket disposed about the rod-shaped lower portion of the stopper and abutting the lower surface of the flange.

15. The adapter according to claim 14, wherein the gasket is an O-ring.

16. The adapter according to claim 12, further comprising a first gasket disposed about the rod-shaped lower portion of the stopper and abutting the lower surface of the flange, an opening defined by the interior chamber, wherein the interior chamber opening communicates with an exterior of the adapter, and a lid which closes the interior chamber opening and compresses the biasing means toward the outlet chamber to create an airtight seal at an interface of the interior chamber opening and the lid.

17. The adapter according to claim 1, wherein the inlet opening is connectable with the liquid source and the outlet opening is connectable with the bas mask.

18. A gas mask liquid delivery system comprising:

a gas mask having a liquid inlet port;

an inlet opening formed at the second end and an outlet opening formed at the first end;

an interior chamber formed within the body;

an inlet chamber extending from the inlet opening to the interior chamber;

an outlet chamber extending from the outlet opening to the interior chamber, wherein the inlet opening, inlet chamber, interior chamber, outlet chamber, and outlet opening define a flow path when placed in open communication with each other to permit the liquid to flow through the flow path; and a stopper disposed within the interior chamber and extending into the outlet chamber, wherein the stopper controls the flow of the liquid through the flow path wherein the outlet opening connects the liquid control adapter directly to the liquid inlet port of the gas mask;

a liquid source;

a connector; and a flow tube which connects the liquid source to the connector, wherein the inlet opening of the liquid control adapter is connected to the connector.

19. The gas mask liquid delivery system according to claim 18, wherein the inlet chamber extends along a first axis and the outlet chamber extends along a second axis, wherein an angle.

20. The gas mask liquid delivery system according to claim 18, further comprising a plunger disposed within the inlet chamber a predetermined distance from the inlet opening.

21. The gas mask liquid delivery system according to claim 18, wherein the interior chamber defines a circular shaped opening which communicates with an exterior of the adapter, and wherein the interior chamber opening is opposite the outlet opening along at least one of the second axis and the longitudinal axis of the interior chamber.

22. The gas mask liquid delivery system according to claim 21, wherein the liquid control adapter further comprises a lip defined by a lower portion of the interior chamber, the lip being disposed intermediate the interior chamber opening and the outlet opening along the longitudinal axis of the interior chamber.

23. The gas mask liquid delivery system according to claim 18, wherein the liquid control adapter further comprises biasing means for biasing the stopper between a first position, wherein the liquid is prevented from flowing through the flow path, and a second position, wherein the liquid is permitted to flow through the flow path.

24. The gas mask liquid delivery system according to claim 23, wherein the biasing means is a spring.

25. The gas mask liquid delivery system according to claim 18, wherein the stopper of the liquid control adapter comprises a flange and a rod-shaped lower portion extending from a lower surface of the flange, the flange of the stopper resting within the interior chamber and the rod-shaped lower portion of the stopper extending into the outlet chamber.

26. The gas mask liquid delivery system according to claim 25, wherein the flange of the stopper has an outer diameter larger than an outer diameter of the rod-shaped lower portion.

27. The gas mask liquid delivery system according to claim 25, wherein the liquid control adapter further comprises a retainer extending from an upper surface of the flange and biasing means for biasing the stopper between a first position which prevents the liquid from flowing through the flow path, and a second position which permits the liquid to flow through the flow path, and wherein the biasing means is disposed about the retainer and abuts the upper surface of the flange.

28. The gas mask liquid delivery system according to claim 25, wherein the rod-shaped lower portion of the stopper includes a plurality of arms defining a plurality of longitudinal channels through which the liquid can flow, wherein each longitudinal channel is defined by a pair of neighboring arms.

29. The gas mask liquid delivery system according to claim 25, wherein the liquid control adapter further comprises a gasket disposed about the rod-shaped lower portion of the stopper and abutting the lower surface of the flange.

30. The gas mask liquid delivery system according to claim 29, wherein the gasket is an O-ring.

31. The gas mask liquid delivery system according to claim 27, further comprising a gasket disposed about the rod-shaped lower portion of the stopper and abutting the lower surface of the flange, an opening defined by the interior chamber, wherein the interior chamber opening communicates with an exterior of the adapter, and a lid which closes the interior chamber opening and compresses the biasing means toward the outlet chamber to create an airtight seal at an interface of the interior chamber opening and the lid.

32. A gas mask liquid delivery system comprising:

a gas mask having a liquid inlet port;

a liquid control adapter, the adapter comprising:

a body having a first end and a second end;

an inlet opening formed at the second end and an outlet opening formed at the first end;

an interior chamber formed within the body;

an inlet chamber extending from the inlet opening to the interior chamber;

an outlet chamber extending from the outlet opening to the interior chamber, wherein the inlet opening, inlet chamber, interior chamber, outlet chamber, and outlet opening define a flow path when placed in open communication with each other to permit the liquid to flow through the flow path; and a stopper disposed within the interior chamber and extending into the outlet chamber, wherein the stopper controls the flow of the liquid through the flow path;

wherein the outlet opening connects the liquid control adapter directly to the liquid inlet port of the gas mask;

a liquid source; and a flow tube which connects the liquid source to the adapter, wherein the inlet opening of the liquid control adapter is connected to the liquid source.

* * * * *